US006019300A

United States Patent [19]

Zoz

[11] Patent Number: 6,019,300

[45] Date of Patent: Feb. 1, 2000

[54] APPARATUS FOR THE HIGH ENERGY AND/OR SUPERFINE MILLING OF SOLIDS AND METHOD OF OPERATING SAME

[75] Inventor: Henning Zoz, Freudenberg, Germany

[73] Assignee: Zoz Maschinenbau GmbH, Wenden-Hunsborn, Germany

[21] Appl. No.: 09/034,518

[22] Filed: Mar. 4, 1998

[51] Int. Cl.[7] ..... B02C 17/16

[52] U.S. Cl. ..... 241/171; 241/172; 241/174; 241/180

[58] Field of Search ..... 241/27, 29, 170, 241/171, 172, 180, 174, 79.1

[56] References Cited

U.S. PATENT DOCUMENTS

| | | | |
|---|---|---|---|
| 2,822,987 | 2/1958 | Uhle | 241/172 |
| 3,149,789 | 9/1964 | Szegvari | 241/27 |
| 3,682,399 | 8/1972 | Kaspar et al. | 241/50 |
| 4,236,677 | 12/1980 | Lodige et al. | 241/172 |
| 4,679,736 | 7/1987 | Orlando | 241/25 |
| 5,464,163 | 11/1995 | Zoz | 241/172 |
| 5,570,846 | 11/1996 | Stehr | 241/21 |
| 5,624,080 | 4/1997 | Stehr et al. | 241/80 |
| 5,630,558 | 5/1997 | Nitta et al. | 241/172 |
| 5,678,776 | 10/1997 | Zoz | 241/171 |
| 5,680,996 | 10/1997 | Sadler, III | 241/57 |

*Primary Examiner*—John M. Husar
*Attorney, Agent, or Firm*—Herbert Dubno

[57] ABSTRACT

A high-energy and superfine attritor for solids has inlet and outer fittings open tangentially into a generally cylindrical milling vessel containing a charge of loose milling bodies. The gas flow through the vessel can alternate in velocity and the rotor speed can alternately pass from a relatively high speed to a relatively low speed.

3 Claims, 2 Drawing Sheets

APPARATUS FOR THE HIGH ENERGY AND/OR SUPERFINE MILLING OF SOLIDS AND METHOD OF OPERATING SAME

FIELD OF THE INVENTION

The present invention relates to an apparatus for the high energy and/or superfine milling of solids and, more particularly, to an attritor of the type in which a charge of loose milling bodies in a closed housing from a milling vessel is induced into intensive motion by the rotation of a rotor having agitator elements about a horizontal axis.

The invention also relates to a method of operating such an attritor.

BACKGROUND OF THE INVENTION

An attritor of the type described can have at least one shaft seal hermetically sealing the shaft of the rotor relative to the housing and can include a closeable port which can be used alternatively as a filling or discharge opening.

Such an attritor is described, for example, in U.S. Pat. No. 5,464,163 corresponding to German Patent Document DE 43 07 083 A1 in which the shaft is sealed at the location at which it is journalled in the housing. Another system of this type is described in U.S. Pat. No. 5,678,776.

The improvement described in U.S. Pat. No. 5,464,163 provides that the shaft seal, the bearing and an end wall of the vessel forms a unit on which different vessels can be mounted.

The apparatus described in these patents generally comminutes a charge of the material to be comminuted, discontinuously. In practice, the fully milled product can be emptied from the vessel along with coarser incompletely milled product. Since the system is operated in a batch mode, clump formation cannot be avoided and aggregates of a product, resulting from magnetic forces or Van der waal's adhesion forces can result. As a result of these clumps, the comminution process is not only delayed, but the clumps can interfere with discharge from the vessel and in the case of incomplete emptying of the vessel at the close of milling process, expensive cleaning operations may be required for the milling vessel and the milling bodies.

OBJECTS OF THE INVENTION

It is the principal object of the present invention to provide an improved method of operating a high energy and superfine milling apparatus which will avoid these drawbacks.

Another object of this invention is to provide an apparatus for high energy and superfine milling of solids which can give rise to highly desirable particulates without disadvantages of earlier systems.

SUMMARY OF THE INVENTION

These objects and others which will become apparent hereinafter are attained, in accordance with the invention, in an apparatus for the high energy and/or superfine milling of solids in which the vessel, usually of cylindrical configuration or centered on an axis of rotation of a rotor, can have an inlet fitting and an outlet fitting spaced apart from the inlet fitting, these fittings opening tangentially relative to an outer circle of revolution of the rotor of the apparatus. The inlet and outlet fittings serve for continuous introduction of the product to be milled and a substantially continuous discharge of milled product.

With the aid of the two fittings, the residence time of the material to be comminuted into the superfine product can be controlled or regulated so that the aforementioned drawbacks and difficulties are avoided.

The particles which are produced can be relatively flat particles as have been found to be desirable in the lacquer and paint industry, especially for the painting or lacquering of automotive vehicles, i.e. for automobile paints, or, in the case of a high milling kinetics, for the formation of particulates for the production of mechanical alloys.

According to a feature of the invention, the inlet fitting and the outlet fitting are spaced apart so that completely milled product may be withdrawn while incompletely milled product can remain in the vessel to continue the milling process. Incompletely milled product may, moreover, be recycled to the vessel. The system can be operated to yield very flat superfine particles by a highly efficient increase in the milling kinetics and thus superfine particles that are effective in the paint industry or are effective for mechanical alloys.

According to a feature of the invention, the inlet and/or outlet fitting may be provided with a sieve plate along the inner wall of the vessel, the sieve plate or sieve plates having the same curvature as this wall.

One of the fittings is axially spaced from but close to one of the vessel end walls while the other fitting is axially spaced from but close to the other end wall of the housing, the fittings being disposed preferably symmetrically on opposite sides of a vertical median plane through the vessel along the axis and terminating at the same distance from a horizontal plane through the axis.

It has been found to be advantageous as in the prior patents, to form the rotor shaft so that it is cantilevered in the vessel from the bearing or seal. It is, of course, also possible to journal the rotor shaft in two bearings located at the end walls of the vessel.

According to yet another feature of the invention, the inlet and outlet fittings extend upwardly from their mouths opening into the vessel to ducts which connect the interior of the vessel to an apparatus for inducing intensive gas circulation through the vessel. The circulation can include a sieve for sifting out the superfine milled product.

According to yet another feature of the invention, the rotor shaft is provided with a drive which is formed with means for periodically shifting the drive speed.

It has been found to be advantageous to introduce the material to be milled through the inlet fitting in the same direction as the movement of the agitator elements at a comparatively high speed (e.g. 1300/min) and at comparatively similar speeds, for example 900/min, in counterflow to the direction of the rotation of the agitator elements.

The milling process and especially the emptying phase is carried out, in intervals, at lower rotor speeds, e.g. 900 revolutions per minute, with the rotor speed being increased thereafter to say 1300 revolutions per minute.

The milling process can be carried out as a continuous process at speeds between 50 and 350 revolutions per minute.

Still another feature of the invention resides in operating during the empty phase of the vessel at reduced and alternately reversing rotor speeds or at least one reversal of direction as compared with the normal milling sense of rotation.

The milling process can be carried out with an intensive gas and solids circulation in a circulation system, whereby the gas flow can penetrate the pile of milling bodies during movement thereof so that the preferred superfine milled product is discharged by entrainment in gas from the milling vessel.

It has also been found to be advantageous to operate the milling process at intervals alternately at a relatively low and relatively high gas flow rate. The discharge of the superfine milled product from the milling vessel can be effected continuously or discontinuously and the gas circulation can be effected utilizing an inert gas like argon, helium or nitrogen, especially argon for the gas circulation.

The milling process can also be carried out with constant process parameters, especially with a constant speed of the rotor.

According to the invention, when the inlet and outlet fittings extend upwardly and are connected to a device for generating an intensive gas circulation, for example, a positive or supercharging blower, a milling circulation is established through the comminuting unit which can enable sifting from the gas of the superfined milled product in an especially effective manner. The circulation can supply the solids tangentially to the rotor in the same direction as the agitators rotate at comparatively high rotary speeds of, for example, 1300/min, while the circulation system can introduce the solids into the attritors in counterflow to the direction of rotation of the rotor at somewhat lower speeds of, for example, 900/min.

It has been found that the milling kinetics can be increased while the tendency toward sticking of the milled product can be reduced by effecting the comminution with rotor speeds at intervals alternating between high and low rotor speeds, the low speeds being of the order of 900 rpm while the higher speeds are of the order of 1300 rpm.

In appropriate cases, the milling process can be carried out with constant process parameters, especially with a constant speed of the rotor. This is especially the case when a clumping and encrustation tendency of the milled product can be avoided. The milled products can include crystalline metal oxides, ceramic synthetic materials, minerals or the like.

BRIEF DESCRIPTION OF THE DRAWING

The above and other objects, features, and advantages will become more readily apparent from the following description, reference being made to the accompanying drawing in which.

SPECIFIC DESCRIPTION

Figure 1:
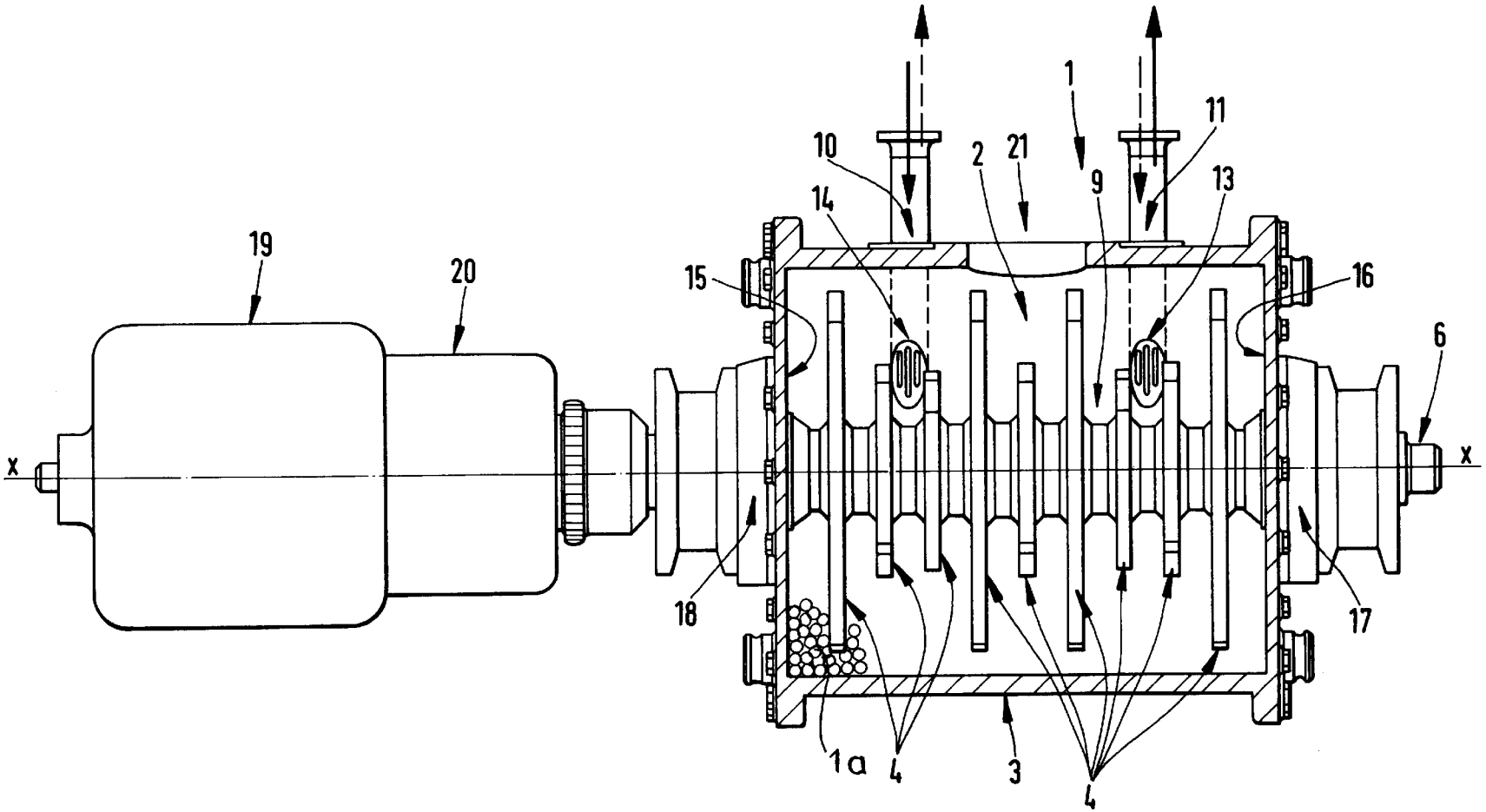
FIG. 1 is a cross sectional view through a milling apparatus or attritor, according to the invention.

The attritor shown in FIG. 1 comprises a milling unit 1 enclosing a milling chamber 2 and formed by a closed housing or vessel 3 containing a loose charge of milling bodies of milling bodies from of which can be seen at 1*a* in FIG. 1.

To induce intensive movement of the milling bodies in the chamber to mill the solids, the apparatus comprises a rotor 9 provided with agitator elements 4 and rotatable about a horizontal axis x-x. The rotor shaft is hermetically sealed relative to the housing 3 by at least one shaft seal represented diagrammatically at 18 at an end wall 16 of the housing. In practice, the shaft can be cantilevered from this wall as described in the aforementioned patents or can be journalled in both end walls 15, 16 with respective sealed bearing units 17, 18.

Figure 2:
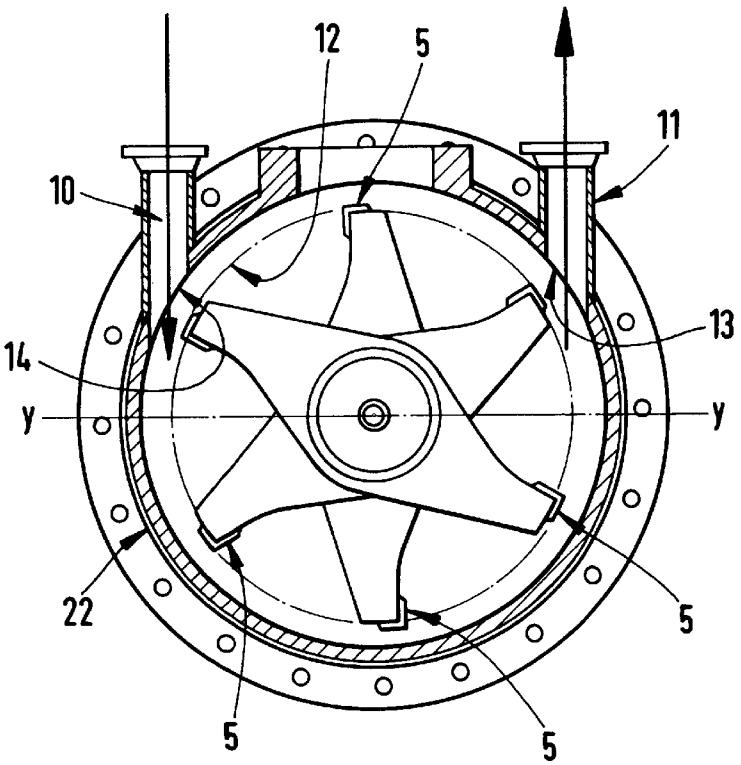
FIG. 2 is a transverse section through the attritor of FIG. 1.

The agitator elements 4 can, as has been shown in FIG. 2, be provided with baffle plates 5 to increase the efficiency of agitation of the milling bodies and to reduce wear of the adjacent elements.

The housing or vessel 3 is also formed with a closeable opening 21 which can serve as a filling opening or an emptying opening for the milling bodies.

According to the invention, the vessel 3 can be provided with an inlet fitting 10 opening into the chamber 2 and an outlet fitting 11 spaced from the inlet fitting 10 and likewise opening into the chamber 2 for delivering the solids to be milled and discharge of the superfine milled solids, respectively. These fittings are arranged so that they are tangential to the outer rotation circle or orbit 12 of the rotor 9 (FIG. 2).

Advantageously, where the fittings 10 and 11 open into the chamber 2, sieve plates 13 and 14 are arranged across the mouths of these fittings and have curvatures conforming to the cylindrical curvature of the housing 3. The sieve plate is provided at least on the outlet fitting 11 but such a plate preferably can be provided on each of the fittings.

Furthermore, and as is visible from FIG. 1, one of the fittings 10 is axially proximal to one of housing end walls 15 while the other fitting 11 is spaced more closely to the other end wall 16 than to the first fitting 10. As can be seen from FIG. 2, the fittings 10 and 11 are disposed on opposite sides of the axis x-x although they can be provided at the same side of the axis x-x as indicated in FIG. 1.

The fittings 10 and 11 are perpendicular to a horizontal plane y-y through the axis x-x and thus can be vertical.

The location of the fittings 10 and 11 to opposite sides of the axis x-x has the advantage, when the system is connected in a gas circulation, that the gas stream will pass through at least a substantial portion of the charge of milling bodies and is best able to separate the fraction of finely milled product from the coarser product and entrain the fine product from the coarse solids which remain in the milling chamber.

Depending upon the size and power of the milling unit, as has been noted, the rotor shaft can be cantilevered from one end wall or journalled in both end walls of the housing 3. The latter is the case for larger volume chambers.

The housing 3 can be surrounded by a cooling or heating jacket 22 (FIG. 2). The bearing seal 17 and 18 can be separately coolable at least at their initial sealing stages.

Figure 3:
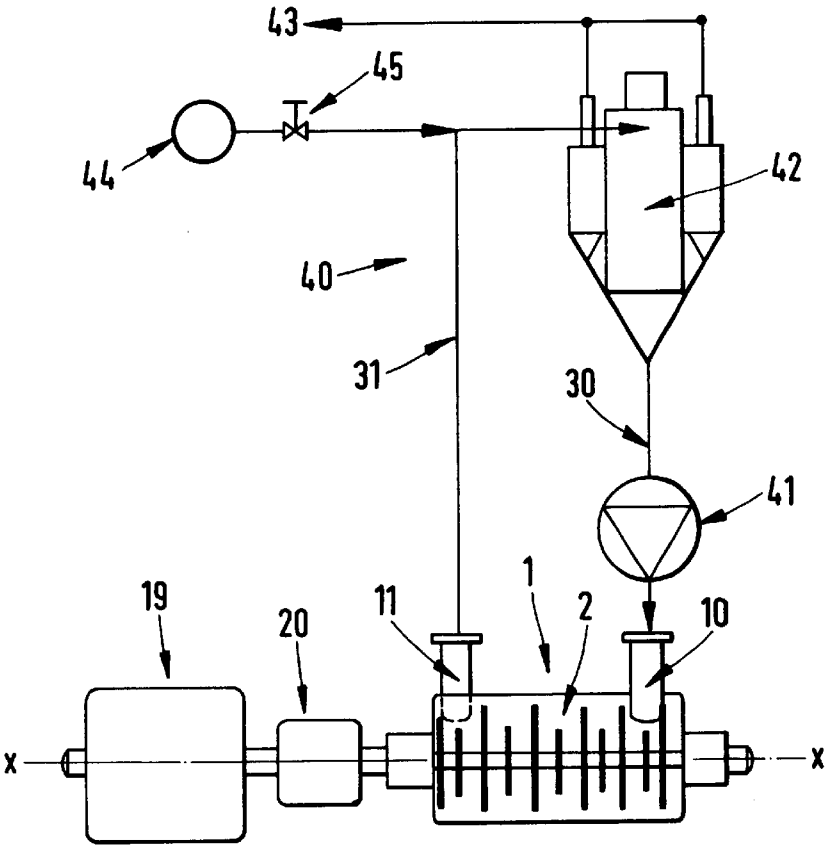
FIG. 3 is a diagram showing a milling circulation for an apparatus of the type illustrated in FIGS. 1 and 2.

As has been noted, and as has been shown in FIG. 3, the fittings 10 and 11 can be connected to ducts 30 and 31 of the milling circulation of a comminution system illustrated only schematically in FIG. 3.

This system can include a device 41 for generating an intensive gas circulation through the milling vessel, preferably a forced displacement blower.

Means can be provided as shown at 42 for sifting the superfinely milled product from more coarse product so that the more coarse product is recycled at 30 to the milling chamber 2 while the fines are discharged at 43.

In FIG. 3 I have shown also in highly schematic form a drive unit 19, 20 for a rotor. This drive unit can comprise an electronic drive motor 19 with a transmission 20. For permanent alternation of the speed between say, 900 rpm and 1300 rpm, the motor 19 can be formed as a pole reversing motor or a thyrister controlled motor. Alternatively, the transmission 20 can be a planetary gear transmission which enables shifting under full load between the lower speed and the higher speed.

In the operation of the comminuting system 20 of the invention a continuous gas circulation is maintained whereby inert gas from the milling chamber 2 entrains the fines through the sieve plate 13 and the fitting 11 via the duct 31 into the sifter 42. The completed fines are discharged at 43 while the coarse material is recycled via duct 31 and the blower 41 and the fitting 10.

It has been surprisingly found that with the alternation at intervals between relatively low and relatively high gas circulation speeds in combination with the milling process which is carried out with alternately low and high rotor speeds, a sticking of the milled product does not occur in the comminution system 40 or is so reduced or suppressed that it does not present a problem. Blockages can be completely avoided in this manner.

Naturally, the effect also depends on the characteristics of the milled product and the characteristics of the entraining gas. The gas can be supplied from the gas source 44 through a regulating valve 45 continuously run in intervals to the circulation, all as has been shown schematically in FIG. 3.

The apparatus is an uncomplicated system which has been found to be surprisingly effective in the superfine milling of a wide variety of solids and to be especially effective in the production of relatively flat particles which have been found to be desirable in the paint industry as well as for mechanical alloying.

By the adjustment of the speed of the rotor in the empty phase, the apparatus can be set up for different types of milling, for example, ball milling, circulating ball milling and the like and a residue free discharge can be insured.

I claim:

1. An apparatus for high-energy and superfine milling of solids, comprising:

a housing forming a milling vessel having a horizontal axis and horizontally spaced end walls;

a loose charge of milling bodies in said housing;

a rotor having a shaft rotatable about said horizontal axis and formed with agitator arms in said vessel for agitating said bodies;

seals hermetically sealing said shaft in said housing, said housing having a closable opening for selectively introducing said milling bodies into and discharging said milling bodies from said vessel;

a vertically upwardly extending linear tubular inlet fitting tangentially opening into said vessel and having an axis tangential to an outer circular orbit of said agitator arms for feeding solids to be milled into said vessel;

a vertically upwardly extending linear tubular outlet fitting tangentially opening into said vessel and having an axis tangential to said outer circular orbit of said agitator arms for withdrawing milled solids from said vessel, said inlet and outlet fittings being spaced inwardly of the respective end walls, axially from one another and on opposite sides of said axis; and ducts connecting said fittings in a milling circulation including a blower for forcing a gas through said circulation and a sifter for separating fine particles from coarse particles entrained in said gas.

2. The apparatus defined in claim 1, further comprising a sieve plate on a mouth of at least one of said fittings, said vessel having a circular curvature and said sieve plate having a curvature corresponding to the curvature of said vessel.

3. The apparatus defined in claim 1, further comprising means operatively connected to said shaft for periodically varying the speed thereof.

* * * * *